US007410136B1

(12) United States Patent
Lombardi

(10) Patent No.: US 7,410,136 B1
(45) Date of Patent: Aug. 12, 2008

(54) PERCUSSION INSTRUMENT CLAMPING SUPPORT

(75) Inventor: Donald G. Lombardi, Westlake Village, CA (US)

(73) Assignee: Drum Workshop, Inc., Oxnard, CA (US)

( * ) Notice: Subject to any disclaimer, the term of this patent is extended or adjusted under 35 U.S.C. 154(b) by 183 days.

(21) Appl. No.: 11/150,087

(22) Filed: Jun. 13, 2005

(51) Int. Cl.
*A47B 96/06* (2006.01)

(52) U.S. Cl. ..... 248/231.41; 248/230.3; 984/154

(58) Field of Classification Search ..... 248/218.4, 248/219.4, 227.3, 230.3, 230.5, 231.41, 231.61; 84/327, 329, 453; 984/150, 154
See application file for complete search history.

(56) References Cited

U.S. PATENT DOCUMENTS 6,015,128 A 1/2000 Lombardi
6,227,510 B1 * 5/2001 McMullen, Sr. ..... 248/311.2
6,283,425 B1 * 9/2001 Liljevik ..... 248/230.4
6,342,138 B1 * 1/2002 Brown ..... 204/297.09
6,390,427 B1 * 5/2002 McConnell et al. .... 248/231.61
6,505,802 B2 * 1/2003 Fowler ..... 248/311.2
6,527,240 B1 * 3/2003 Huang ..... 248/311.2
6,559,368 B1 * 5/2003 Sikra et al. ..... 84/421
6,575,652 B2 * 6/2003 Krauss ..... 403/49
6,663,068 B2 * 12/2003 Huang ..... 248/311.2
6,719,255 B2 * 4/2004 Chen ..... 248/323
6,921,053 B1 * 7/2005 Heck ..... 248/65

* cited by examiner

*Primary Examiner*—A. Joseph Wujciak, III
(74) *Attorney, Agent, or Firm*—William W. Haefliger

(57) ABSTRACT

For use with a percussion instrument, the combination comprises a clamp base to support the percussion instrument, a clamp jaw, adjustable connector structure connecting the jaw to the base for displacing the jaw toward and away from the base, and clamping structure carried on at least one of the jaw and the base to be clamped against a support member in response to relative clamping displacement of the jaw and base, whereby adjustment of the structure accommodates to clamping of different size support members by clamping structure.

2 Claims, 3 Drawing Sheets

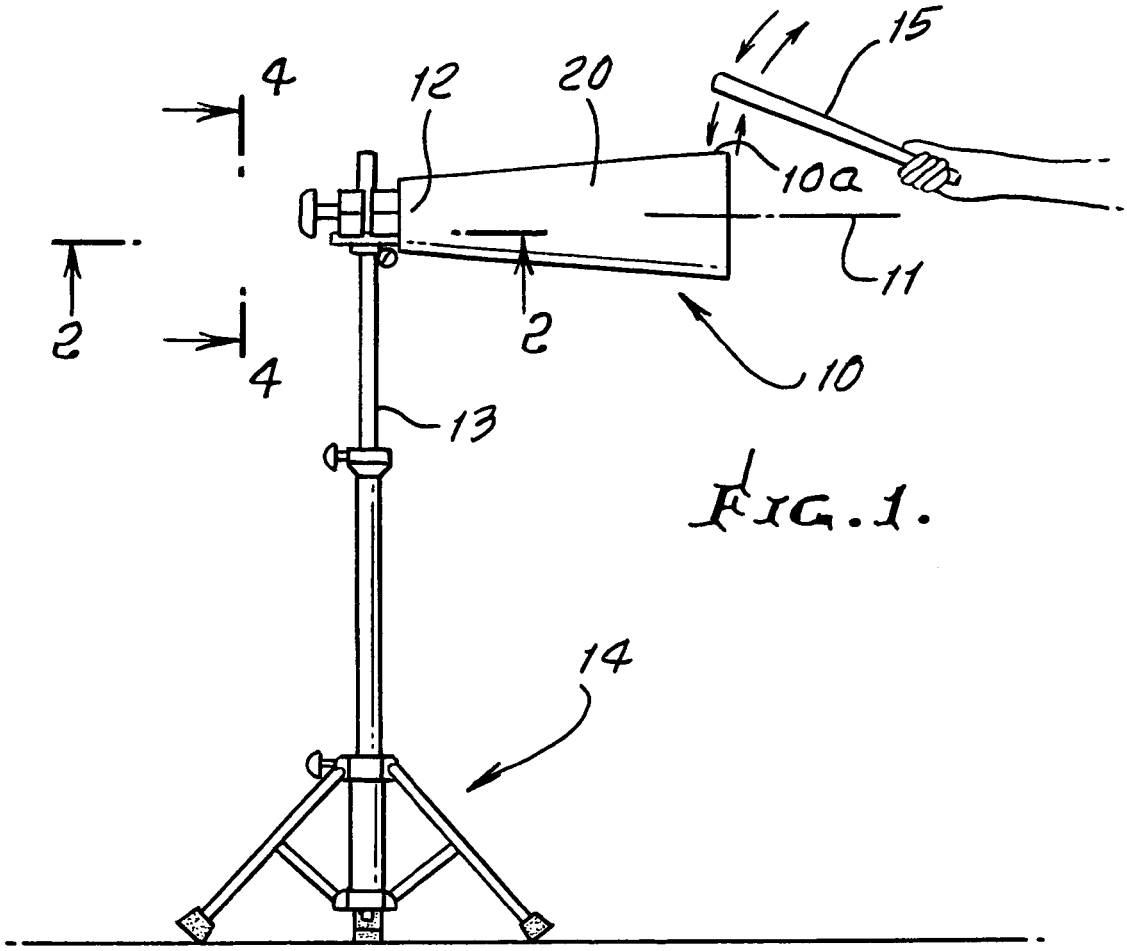
FIG. 1.
FIG. 4.
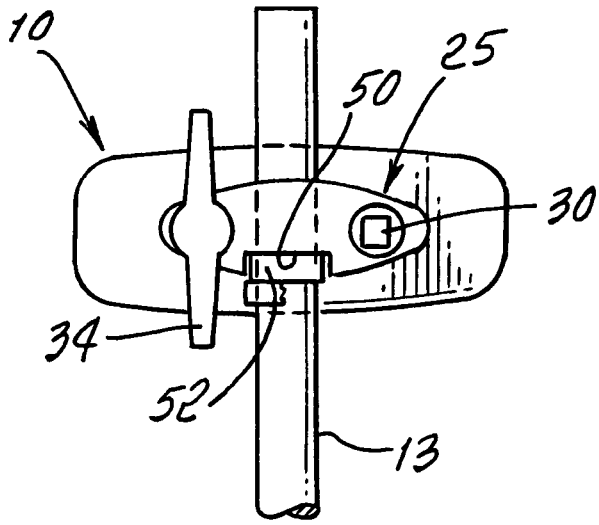

PERCUSSION INSTRUMENT CLAMPING SUPPORT

BACKGROUND OF THE INVENTION

This invention relates generally to improvements in percussion instruments and their supports, and more particularly to supports for metallic bell percussion instruments having horn shaped bodies projecting from supported ends.

In the past, bell type percussion instruments were supported by tightenable structures, such as set screws, that tended to loosen due to vibration of the bell resulting from drumstick repeated impact on the instrument. As a result, the drummer was faced with having to reach downward or forward at frequent intervals, and re-tighten the support structure. There is need for improvements in mechanism which supports the head end of the relatively heavy metallic bell in a forwardly diverging position of the bell, and which does not tend to loosen during a performance.

There is also need for a way to support the percussion instrument on an upright stand, and at a predetermined level or height, at which the support end of the bell is clamped to the stand, whereby elevation positioning of the instrument is achieved.

There is further need for additional improvements in apparatus, functioning, and results, as are disclosed herein.

SUMMARY OF THE INVENTION

It is a major object of the invention to provide an improved support for a metallic bell shaped percussion instrument having a head and a skirt projecting and flaring away from the head. Basically, the support comprises:

a) a clamp base to support the percussion instrument, b) a clamp jaw, c) adjustable connector structure connecting the jaw to the base for displacing the jaw toward and away from the base, d) and clamping means carried on at least one of the jaw and the base to be clamped against a support member in response to relative clamping displacement of the jaw and base, whereby adjustment of said structure accommodates to clamping of different size support members by said clamping means.

As will be seen, the clamping means typically has a first shoulder to engage a second shoulder on the support member to determine clamp positioning lengthwise of the support member.

Another object is to provide the adjustable connection structure to have dual threaded parts at opposite sides of a gripper carried by one of the base or jaw. The gripper may have a gripping surface, as in V-shape, to laterally locate the gripping on the support member. A second and similar gripper may be provided to the other of the base and jaw, facing the first gripper.

Yet another object is to provide a first shoulder on the gripper to engage a second shoulder on the support member to determine clamp positioning relative to the support member. That shoulder may project downwardly to engage a positioning shoulder that determines the height of the jaw, gripper and percussion instrument, relative to the support member.

These and other objects and advantages of the invention, as well as the details of an illustrative embodiment, will be more fully understood from the following specification and drawings, in which:

DRAWING DESCRIPTION

FIG. 1 is an elevation showing a percussion bell supported on a rod and stand, to be struck by a drumstick;

FIG. 4 is an elevation taken on lines 4-4 of FIG. 1;

DETAILED DESCRIPTION

Figure 2:
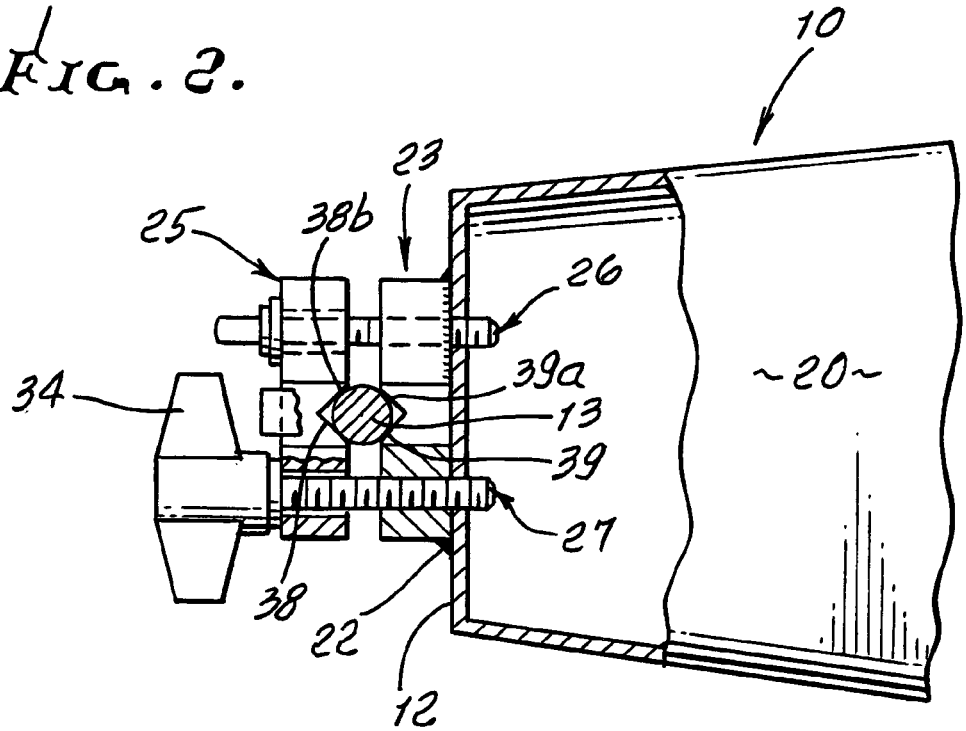
FIG. 2 is an enlarged bottom plan view taken on lines 2-2 of FIG. 1.

The drawings show a metallic bell 10, in the shape for example of a cow bell; and in FIG. 1 the bell projects and flares laterally and defines a lateral substantially horizontal axis 11. The bell has a head end 12 supported by an upright rod 13 carried by a support stand 14. The elements 10, 12, 13, and 14 may take various forms or configurations. A drumstick 15 is shown being hand manipulated to repeatedly strike the end or top edge 10*a* of the bell. A wear plate may be attached as by fasteners to the bell wall, at its end, to be struck by the stick 15, to prevent stick breakage and/or wear.

Figure 3:
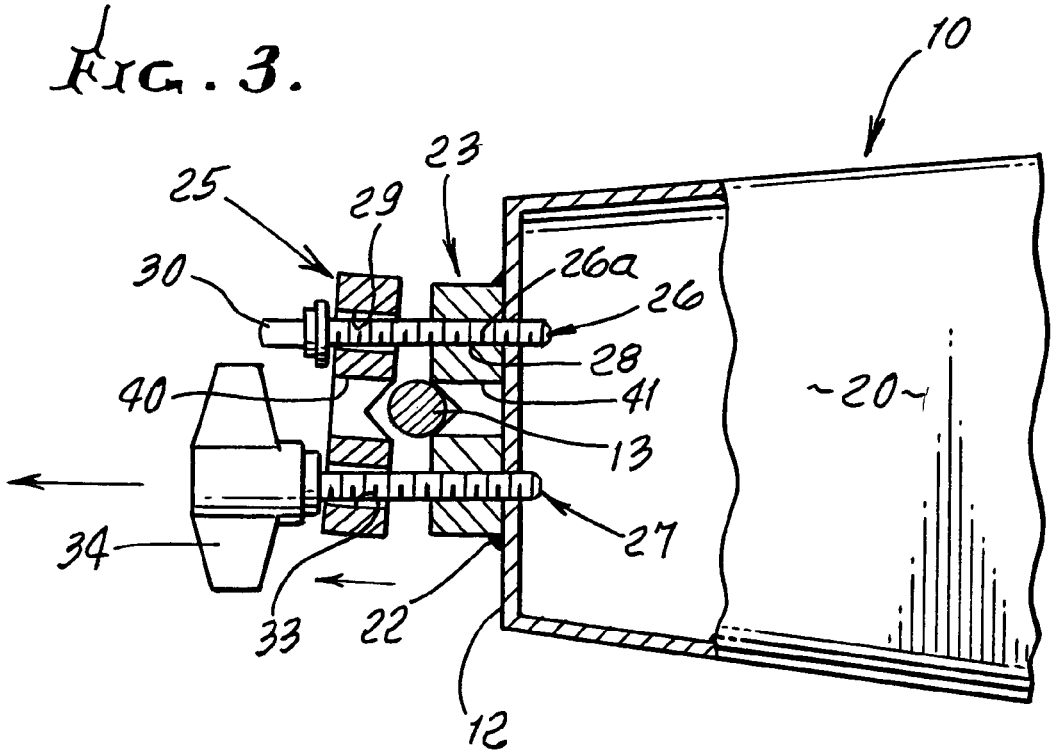
FIG. 3 is a view like FIG. 2, with a clamping means loosened, to allow vertical adjustment of the bell supporting apparatus, on a rod.

Referring to FIGS. 2-4, the hollow bell shell 20 has a head end 12, attached as by weld 22 or other means to a block shaped clamp base 23, for supporting the bell. As shown, the base has a flat side engaging the head end.

A clamp jaw 25 faces the base 23, with rod 13 extending upwardly therebetween. Adjustable connector structure connects the jaw to the base for displacing the jaw toward and away from the base. Such structure may take various forms, but in the drawings it is shown to include two fasteners 26 and 27. Fastener 26 has threaded portion 26*a* for engaging the base at thread 28. The fastener extends loosely through bore 29 in the jaw, and has a rotatable head 30 at the rear side of the jaw for tightening of the jaw toward the base. Loose fit of the fastener in bore 29 allows limited tilting of the jaw to permit insertion of the rod 13 into position between the jaw and base, as shown.

Fastener 27 also has a threaded portion 27*a* for engaging the base at thread 32. Fastener 27 extends loosely through bore 33 in the jaw, and has a rotatable head in the form of a handle 34 at the rear side of the jaw for tightening of the jaw toward the base. Loose fit of the fastener 27 in bore 33 allows limited tilting of the jaw to permit adjustment positioning of the jaw, relative to the base and rod for efficient and rapid clamp fitting of the jaw to the rod, when handle 34 is adjustably rotated, by the user's hand.

Clamping means is carried by at least one of the jaw and base, and preferably by both, to be fittingly clamped against the support member (i.e. rod 13 in the example), in response to relative closing displacement of the jaw and base, whereby adjustment of the adjustable structure accommodates to clamping of different size, i.e. diameter, support members by the clamping means. The clamping means typically include at least one gripper having a rod gripping surface to engage the support member or rod 13. Preferably, two such grippers are provided, as for example gripper 38 carried by the jaw, and gripper 39 carried by the base. Gripper 38 has a V-shaped groove or notch 38*b* fittingly engagable against one curved side of the rod; and gripper 39 also has a V-shaped groove or notch 39*a* fittingly engagable against the opposite curved side of the rod, as shown. In this regard, gripper 38 may be integral with, or part of the jaw; and gripper 39 may be integral with or part of the base. As shown, the grippers are received within and retained by slots 40 and 41 in the jaw and base. When the jaw is tightened toward the base, the grippers accommodate to, and grip the rod 13 therebetween, as also enabled by tilting of the jaw.

Figure 5:
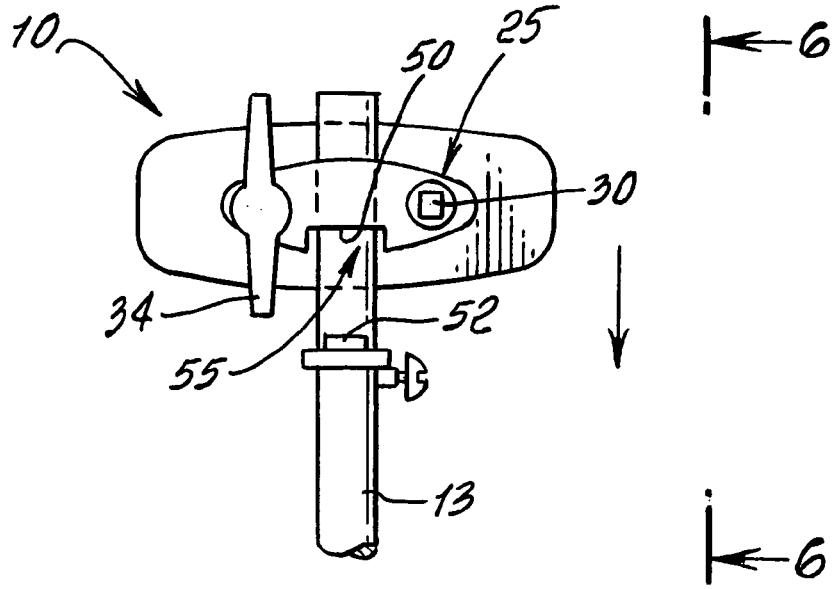
FIG. 5 is a view like FIG. 4, and showing the apparatus being lowered to supported position on the rod.
Figure 6:
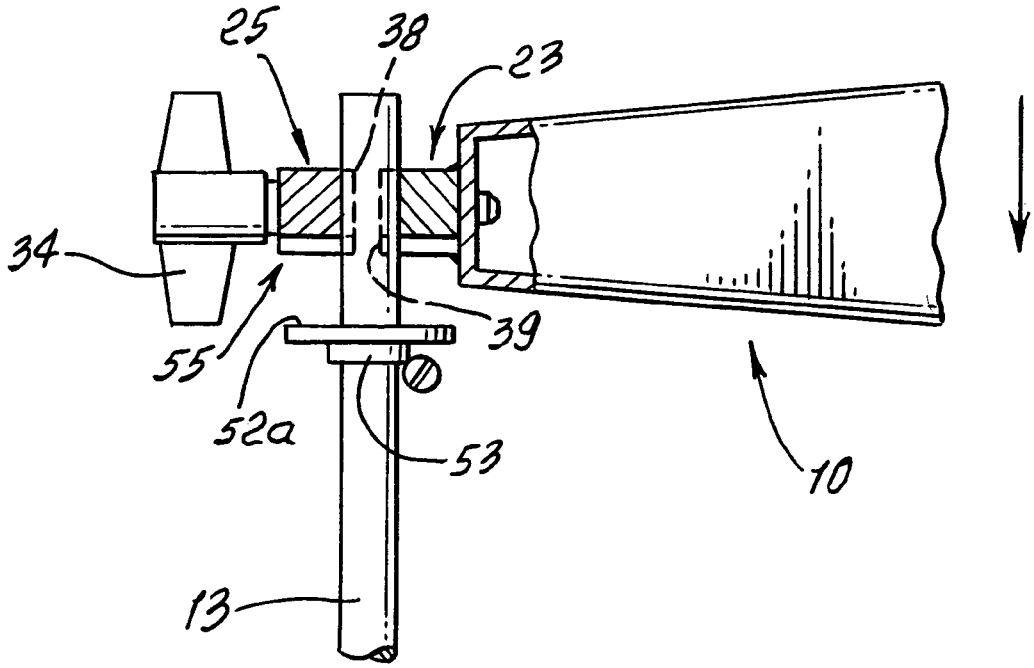
FIG. 6 is an elevation taken on lines 6-6 of FIG. 5.

The clamping means also has a first shoulder, as on a gripper 38, that is positioned to engage a second shoulder on the support member 13, or on another part of the stand, to positively determine clamp positioning relative to the support member. See for example first shoulder 50 presented at the lower side of the gripper 38, to engage second shoulder 52*a* on stop 52 on rod 13. Stop 52 may be adjustably positioned lengthwise of the rod, as by an adjustable clamp 53 holding the stop in selected height position. When the bell is to be assembled to the stand, the rod is interfitted between grippers 38 and 39, and the grippers, jaw and base are lowered as from upper position as seen in FIGS. 5 and 6, to lowered position as seen in FIG. 4 wherein the shoulder 50 engages the stop. Shoulder 50 is shown in a notch 55 formed by one or both grippers, as seen in FIG. 5. This positioning locates the cow bell, in pre-selected height position, relative to the stand, contributing to rapid assembly of the apparatus by a musician-user of the apparatus.

Other percussion instruments supportable as disclosed include tambourines, and impact blocks.

I claim:

1. A clamp in combination with a cowbell percussion instrument, the combination comprising a) a clamp base rigidly attached to an end wall of the cowbell percussion instrument, b) a clamp jaw, c) adjustable connector structure connecting the jaw to the base for displacing the jaw toward and away from the base, d) a support member in the form of a rod, and means for clamping to the support member, and carried on at least one of the jaw and the base, in response to relative clamping displacement of the jaw and base, whereby adjustment of said structure accommodates to clamping of different size support members by said means, e) said connector structure including two threaded fasteners extending loosely through bores defined by and extending loosely entirely through the jaw, and being thread connected to the base whereby the jaw has adjustably tilted position during tightening of said jaw to said support member, said fasteners having jaw engaging heads located externally of said jaw, whereby only shanks defined by the fasteners extend through said bores, the heads overlapping all bore ends defined by the bores, externally thereof, in jaw tilted positions, and sufficiently that the heads do not engage the bores during said tilting, one of the heads defining an enlarged handle spaced from the other head, f) the clamping means including a first gripper carried by the jaw, and a second gripper carried by the base, g) each said grippers having a gripping surface defined by a notch, each gripping surface having V-shape, the gripping surfaces facing each other, h) and including a first shoulder on the first gripper that projects downwardly to engage a positioning shoulder on the rod that determines the height of the jaw, gripper and percussion instrument, relative to the rod, said positioning shoulder being adjustable lengthwise of the rod which extends upright.

2. The combination of claim 1 wherein said adjustable connector structure is offset relative to said clamping means.

* * * * *